US006779451B2

(12) United States Patent
Vrotacoe et al.

(10) Patent No.: US 6,779,451 B2
(45) Date of Patent: Aug. 24, 2004

(54) FLEXIBLE TUBULAR PRINTING BLANKET

(75) Inventors: James Brian Vrotacoe, Rochester, NH (US); Roland Thomas Palmatier, Durham, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 61 days.

(21) Appl. No.: 09/892,253

(22) Filed: Jun. 27, 2001

(65) Prior Publication Data

US 2003/0000404 A1 Jan. 2, 2003

(51) Int. Cl.[7] ..... B41N 3/00
(52) U.S. Cl. ..... 101/463.1; 101/453
(58) Field of Search ..... 101/453, 457, 101/462, 463.1

(56) References Cited

U.S. PATENT DOCUMENTS

| | | | | |
|---|---|---|---|---|
| 5,112,656 A | * | 5/1992 | Nakamura et al. | 427/425 |
| 5,304,267 A | | 4/1994 | Vrotacoe et al. | 156/86 |
| 5,323,702 A | | 6/1994 | Vrotacoe et al. | 101/217 |
| 5,352,507 A | * | 10/1994 | Bresson et al. | 428/35.9 |
| 5,429,048 A | | 7/1995 | Gaffney et al. | 101/217 |
| 5,440,981 A | | 8/1995 | Vrotacoe et al. | 101/217 |
| 5,553,541 A | | 9/1996 | Vrotacoe et al. | 101/217 |
| 5,654,100 A | | 8/1997 | Koebler et al. | 428/390 |
| 5,768,990 A | | 6/1998 | Vrotacoe et al. | 101/217 |
| 6,080,258 A | * | 6/2000 | Tittgemeyer | 156/192 |
| 6,257,140 B1 | * | 7/2001 | Palmatier et al. | 101/401.1 |
| 2002/0069777 A1 | * | 6/2002 | Rossini et al. | 101/401.1 |

FOREIGN PATENT DOCUMENTS

| | | | |
|---|---|---|---|
| DE | 19720549 | 5/1997 | B41F/30/06 |
| DE | 19951354 | 5/2001 | |
| EP | 0366395 | 5/1994 | |
| JP | 63005997 | 1/1988 | |
| WO | 0130574 | 5/2001 | |

OTHER PUBLICATIONS

Abstract of DE 19720549 (In English).

* cited by examiner

*Primary Examiner*—Daniel J. Colilla
(74) *Attorney, Agent, or Firm*—Davidson, Davidson & Kappel, LLC

(57) ABSTRACT

A method for forming a tubular printing blanket includes the steps of applying a application layer to a base, applying a polymer over the application layer so as to form as flexible inner tubular sleeve, at least one of the application layer and the polymer being an innermost layer of the tubular sleeve, and applying a print layer over the tubular sleeve. The interior of the flexible tubular sleeve can collapse to permit better storage of the blankets.

10 Claims, 5 Drawing Sheets

FLEXIBLE TUBULAR PRINTING BLANKET

BACKGROUND INFORMATION

The present invention relates to the offset printing blankets, and more particularly, to tubular offset lithographic printing blankets and methods for manufacturing the same.

A web offset printing press typically includes a plate cylinder, a blanket cylinder and an impression cylinder supported for rotation in the press. The plate cylinder carries a printing plate having a rigid surface defining an image to be printed. The blanket cylinder typically carries a printing blanket having an outer print layer, for example of rubber, which contacts the printing plate at a nip between the plate cylinder and the blanket cylinder. A web to be printed moves through a nip between the blanket cylinder and the impression cylinder. Ink is applied to the surface of the printing plate on the plate cylinder. An inked image is picked up by the printing blanket at the nip between the blanket cylinder and the plate cylinder, and is transferred from the printing blanket to the web at the nip between the blanket cylinder and the impression cylinder. The impression cylinder can be another blanket cylinder for printing on the opposite side of the web.

A conventional printing blanket is manufactured as a flexible flat sheet. Such a printing blanket is mounted on a blanket cylinder by wrapping the sheet around the blanket cylinder and by attaching the opposite ends of the sheet to the blanket cylinder in an axially extending gap in the blanket cylinder. The adjoining opposite ends of the sheet define a gap extending axially along the length of the printing blanket. The gap moves through the nip between the blanket cylinder and the plate cylinder, and also moves through the nip between the blanket cylinder and the impression cylinder, each time the blanket cylinder rotates.

When the leading and trailing edges of the gap at the printing blanket move through the nip between the blanket cylinder and an adjacent cylinder, pressure between the blanket cylinder and the adjacent cylinder is relieved and established, respectively. The repeated relieving and establishing of pressure at the gap causes vibrations and shock loads in the cylinders and throughout the printing press. Such vibrations and shock loads detrimentally affect print quality. For example, at the time that the gap relieves and establishes pressure at the nip between the blanket cylinder and the plate cylinder, printing may be taking place on the web moving through the nip between the blanket cylinder and the impression cylinder. Any movement of the blanket cylinder or the printing blanket caused by the relieving and establishing of pressure at that time can smear the image which is transferred from the printing blanket to the web. Likewise, when the gap in the printing blanket moves through the nip between the blanket cylinder and the impression cylinder, an image being picked up from the printing plate by the printing blanket at the other nip can be smeared. The result of the vibrations and shock loads caused by the gap in the printing blanket has been an undesirably low limit to the speed at which printing presses can be run with acceptable print quality.

In response to these deficiencies in conventional flat printing blankets, gapless tubular printing blankets were developed by the assignee of the present invention. These gapless tubular printing blankets are described, for example, in U.S. Pat. Nos. 5,768,990, 5,553,541, 5,440,981, 5,429,048, 5,323,702, and 5,304,267. These tubular blankets however have required that the print layer and compressible layers be supported by a stiff inner sleeve, for example made of nickel. The tubular blankets thus were not flexible, in that the inner surface of the sleeve could not contact itself or collapse without damaging the layers of the blanket. The tubular blankets thus need to be stored in a tubular shape, taking up valuable space in a press room or print shop.

U.S. Pat. No. 5,654,100 discloses an offset rubber-blanket sleeve with rubber as a base material, reinforced by layer inserts embedded therein, such as a spiral winding to provide similar strength to a fiberglass or metallic sleeve. The sleeve is thus not collapsible.

SUMMARY OF THE INVENTION

Commonly-assigned U.S. Pat. No. 6,257,140, which is hereby incorporated by reference herein, describes gapless tubular printing blankets produced continuously and cut to length as desired. The sleeve and print layer are "continuously" formed in that the sleeve forming station continues to form an additional portion of the sleeve while the print layer forming station applies the print layer to the previously formed portion of the sleeve. Wound tapes or cross-head extruders are used to apply various layers.

Commonly-assigned U.S. Pat. No. 6,538,970 discloses a machine for winding a sleeve, and is also incorporated by reference herein.

Commonly-assigned U.S. patent application Ser. No. 09/716,696, which is hereby incorporated by reference herein, provides for ribbon casting of materials to form various layers of a tubular printing blanket. "Ribbon casting" occurs when a liquid material is deposited from a stationary source onto a rotating and translating substrate or that a liquid is deposited from a rotating source onto a translating substrate. A continuous ribbon of liquid material thus can be placed on the substrate. Urethane is used in the ribbon casting process. The urethane sets after a certain time.

All of the sleeves in the above-mentioned patent applications were designed to be stiff, typically being made of metal.

The present invention provides a device for manufacturing a flexible continuous printing blanket comprising:

a base;

an application layer located directly on the base;

a polymer applicator applying a polymer layer over the application layer so as to define a flexible sleeve layer, at least one of the application layer and the polymer layer being an innermost layer of the sleeve layer; and a print layer applicator applying a print layer over the flexible sleeve layer.

The flexible sleeve of the present invention permits for better storage of blankets.

Preferably, a compressible layer applicator is located between the polymer layer and print layer applicators. The compressible layer applicator preferably applies a radiation-curing polymer that is a compressible liquid polymer, such as urethane mixed with microspheres, carbon dioxide, a blowing agent or water, for example.

Preferably, the radiation-curing polymer is polyurethane, and the radiation source is ultraviolet light. An electron beam also may be used for curing the polymer.

The sleeve preferably is made of urethane, for example a self-cure or radiation-curing urethane. A polyurethane layer with a hardness of at least 70 Shore A and most preferably a hardness of about 70 Shore D is preferred as the sleeve material.

The flexible application layer may be part of the sleeve, and may be made of a pre-fabricated tape that wraps around the rotating base. The tape may be a polyurethane film with a hardness of at least 70 Shore A and most preferably a hardness of about 70 Shore D is preferred as the sleeve material.

Alternately, the flexible application layer may be a release layer separating the base from the polymer applied by the polymer applicator.

The release layer may be for example a TEFLON tape which is removed from the flexible sleeve layer.

The present device preferably includes a rotation device for rotating the base, and the base and rotation device may be similar to the base devices used to form blankets in incorporated-by-reference U.S. Pat. Nos. 6,257,140 and 6,538,970 and U.S. application Ser. No. 09/716,696. These devices as a plurality of slats which push the sleeve so as permit a continuous manufacture.

Optional surface finishers for smoothing the surface may be located after the various applicators.

The sleeve may be formed continuously, so that a cutting device may be provided to cut the sleeve when a desired sleeve length is reached.

The present invention also provides a method for forming a tubular printing blanket comprising the steps of:

applying an application layer to a base;

applying a polymer over the application layer so as to form as flexible tubular sleeve, at least one of the application layer and the polymer being an innermost layer of the tubular sleeve; and applying a print layer over the flexible tubular sleeve.

The method preferably includes forming a compressible layer over the flexible tubular sleeve and under the print layer.

The method may include removing the flexible application layer.

The applying of the flexible application layer may include winding a tape around the rotating base.

The method preferably further includes rotating the base.

The compressible layer may be a radiation curable polymer of a compressible material, for example UV-curable urethane. A curing step then preferably takes place in a few seconds, although times up to 5 minutes are possible.

A smoothing step may be provided both after and before the curing step.

The flexible sleeve can be pre-manufactured, and then used in a separate process to make the blanket. Alternately, the blanket can be made in a single continuous process.

Preferably, the print layer, compressible layer and flexible sleeve are made of urethane, and a reinforcing layer is provided between the compressible layer and the print layer. The reinforcing layer is also preferably made of urethane.

The reinforcing layer preferably is made of a high durometer urethane of greater than 70 shore A, most preferably about 70 shore D.

The print layer preferably is made of a urethane with a durometer of less than 80 shore A and most preferably of about 60 shore A.

The method of the present invention preferably includes compressing the printing blanket so that two different circumferential points of an inner surface of the sleeve when round contact each other. This permits for example storage of the sleeve. Preferably, most of the inner surface contacts itself. Various fold shapes are possible, depending on the storage area available.

The method also includes sliding the printing blanket over a cantilevered cylinder of an offset lithographic printing press.

The present invention also provides an offset printing blanket comprising:

a flexible and collapsible inner sleeve made of polymeric material, the sleeve being the innermost layer of the blanket; and a print layer disposed over the flexible inner sleeve.

Preferably, a compressible layer is disposed between the print layer and the inner sleeve, and a reinforcing layer is disposed over the compressible layer and under the print layer.

The flexible inner sleeve may be made of urethane.

BRIEF DESCRIPTION OF THE DRAWINGS

The present invention is described in more detail with reference to the following figures, in which.

DETAILED DESCRIPTION

Figure 1:
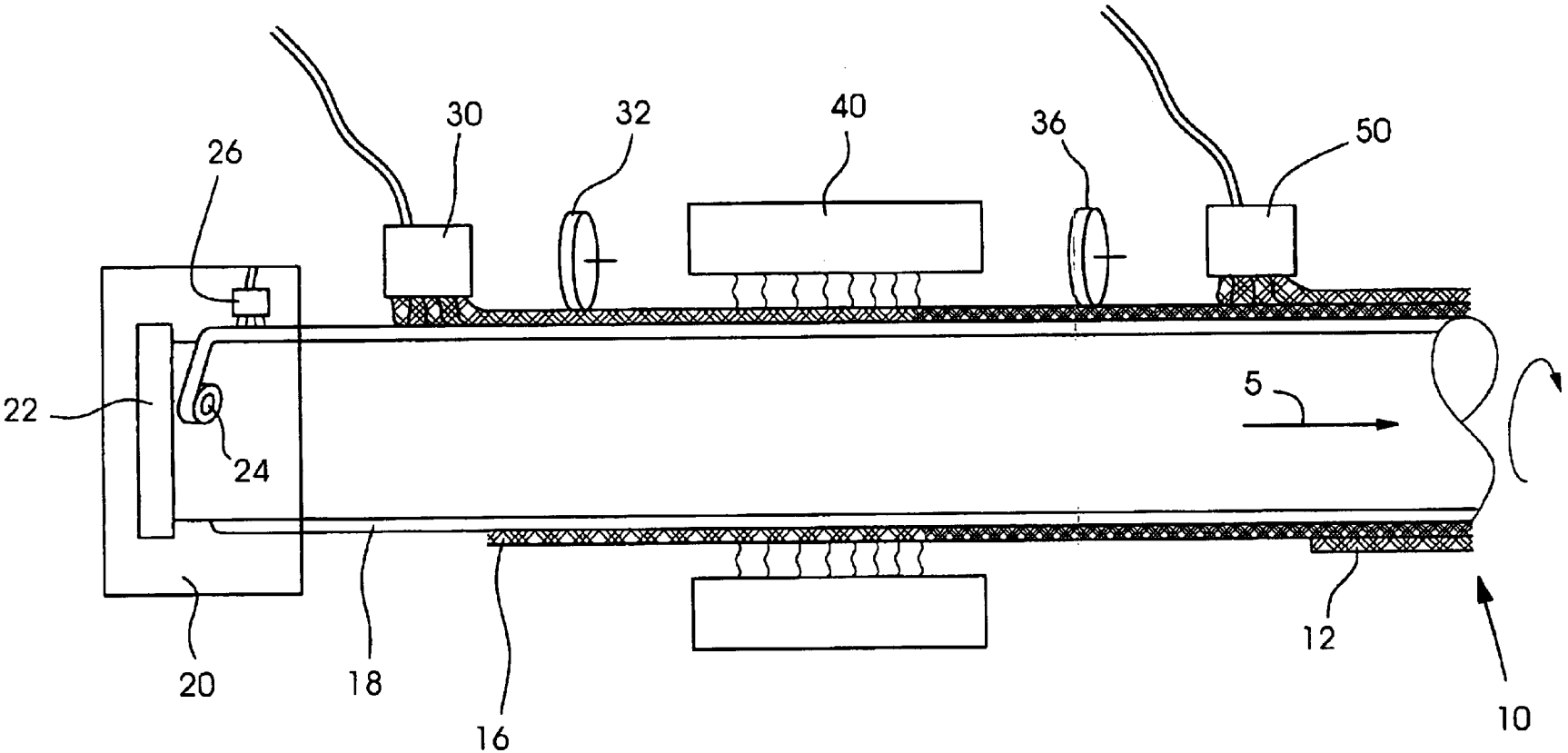
FIG. 1 shows a device for manufacturing a tubular printing blanket according to the present invention.

FIG. 1 shows a device for manufacturing a preferred lithographic continuous-process gapless tubular flexible printing blanket 10. In this regard, the term "continuous process" indicates that the process creates a continuous tubular blanket of undetermined axial length.

A sleeve forming station 20 forms a flexible sleeve 18. The sleeve forming station 20 includes a rotation and translation device or base 22, for example one having a series of axially-translating and rotating slats, as described in the incorporated-by-reference U.S. patent application Ser. No. 09/716,696, for example.

Figure 2:
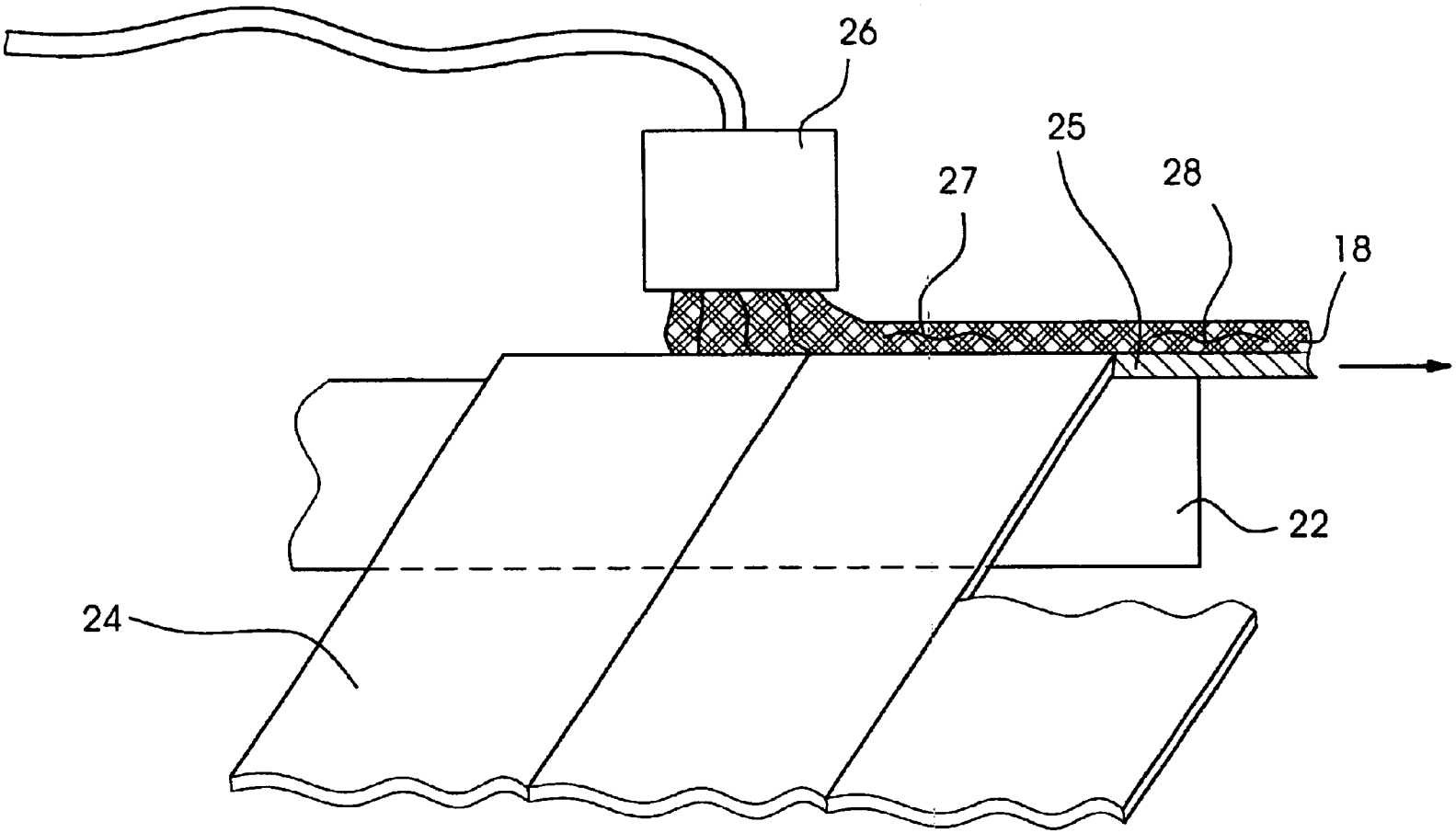
FIG. 2 shows more detail of one embodiment of the sleeve-forming station of FIG. 1.

In a first embodiment shown in FIG. 1 and in more detail in FIG. 2, sleeve forming station 20 includes a flexible polymer tape 24, for example made of urethane, which is wound over slates of the rotation and translation device so as to form a flexible application layer 25.

On the application layer 25 is deposited a polymer using a liquid applicator 26, which may be for example a spraying device. At a location 27, the deposited polymer is still in a flowable form, and at a location 28 the liquid has cured so as to harden. The polymer may be a self-cure polyurethane, for example, or a UV-cure polyurethane, in which case UV light is applied to the outer surface of the sleeve 18.

In this embodiment, the flexible application layer 25 and the polymer together form sleeve 18. Preferably, both the layer 25 and the polymer have a hardness of at least 70 Shore A and most preferably of about 70 Shore D.

Figure 3:
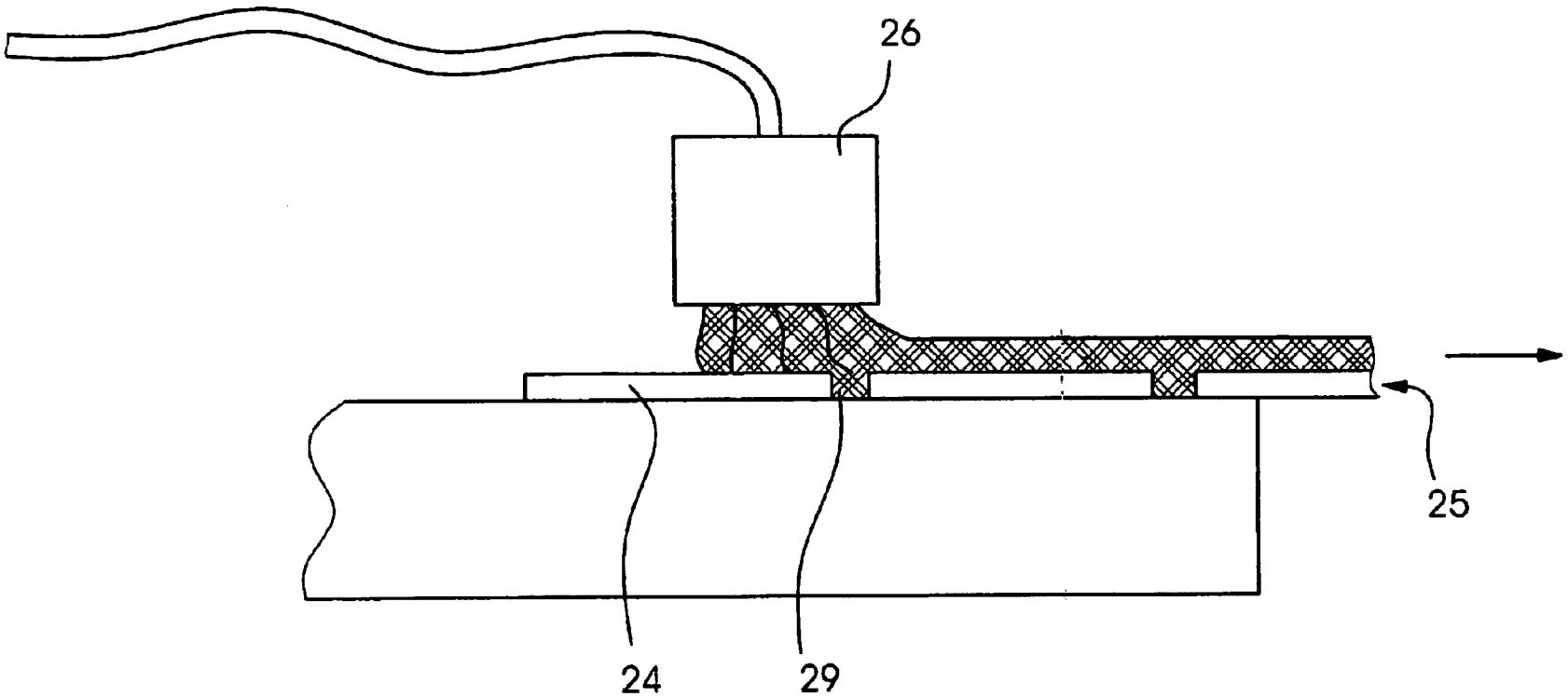
FIG. 3 shows more detail of the sleeve forming device in FIG. 2, with a preformed tape at a wider spacing.

As shown in FIG. 3, tape 24 need not align perfectly, and some of the polymer can flow into interstices 29 of layer 25. This is advantageous, since alignment of the tape can be difficult.

Figure 4:
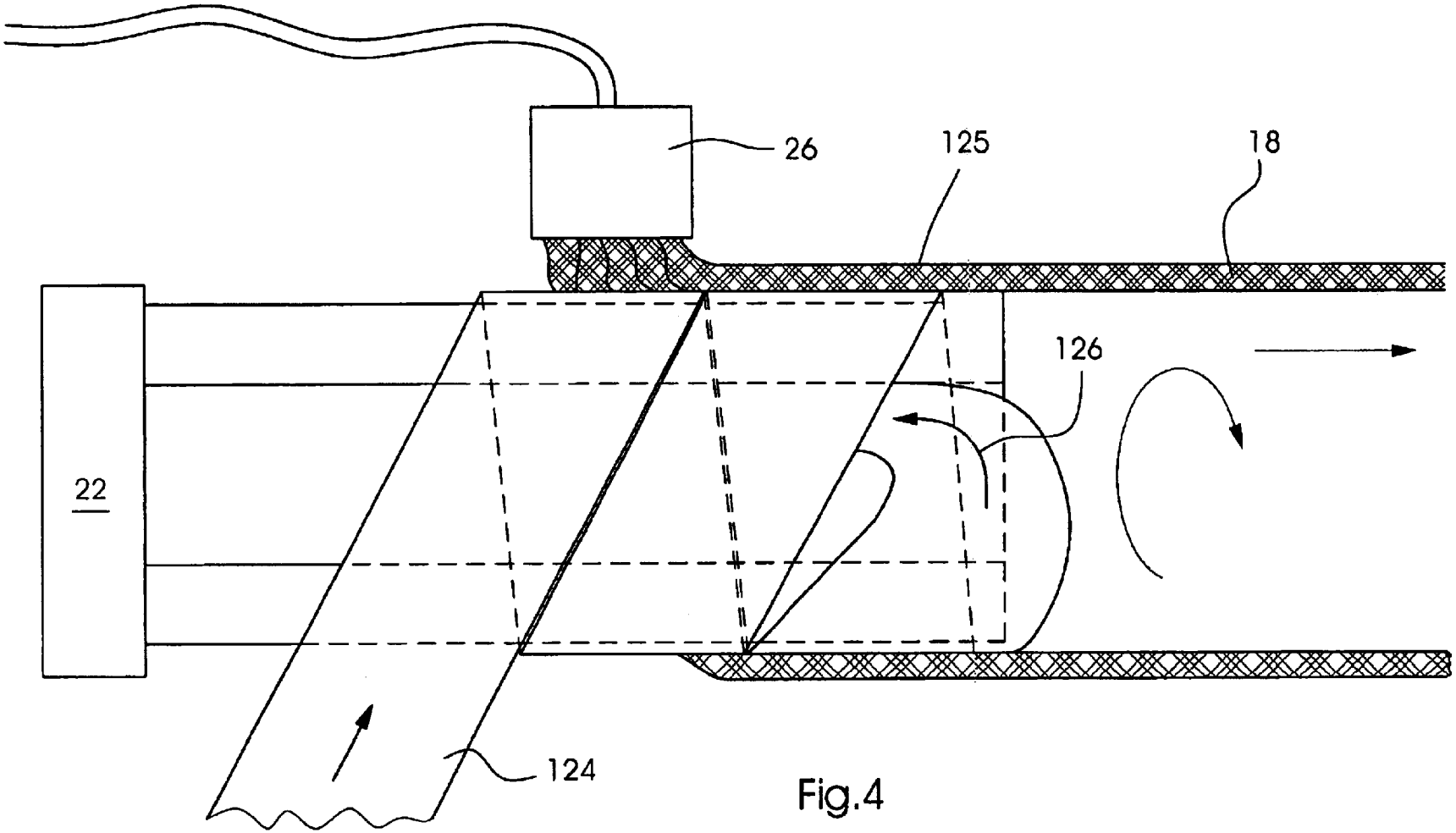
FIG. 4 shows an alternate embodiment of the sleeve-forming station of FIG. 1.

FIG. 4 shows an alternate embodiment of sleeve-forming station 20. A release tape 124, with for example a TEFLON outer coating slides over the outer surface of rotating and translation device 22. On top of the application layer 125 formed by the TEFLON tape is deposited a polymer by a liquid applicator 26, the polymer preferably being urethane.

The polymer then cures, for example using UV light, while still on application layer 125. The cured polymer thus forms tubular sleeve 18. The release tape 124 can be pulled out the front end of the sleeve forming station 20, as shown by arrow 126.

An alternate to the tape 124 for application layer 125 is a release agent, for example dried TEFLON spray, for example 0.0001" in thickness. This layer then can remain as part of sleeve 18, or can remain part of rotating and translating device 22. Application layer 125 also could be a permanent coating on the rotating and translating device 22, such as TEFLON-impregnated nickel.

As shown in FIG. 1, over sleeve 18 is applied a compressible layer 16 of, for example, UV-curing urethane, commercially available from the Bomar Specialties Company of Conn., for example. The urethane may be applied for example in liquid form from a polymer liquid applicator 30, which for example may be a spraying device. The radiation-curing urethane may be premixed before application, and then blown with a blowing agent or carbon dioxide for example to add compressibility.

A smoothing station 32, for example a doctor blade or planing device, can reduce undulations in the applied compressible layer 16.

The layer 16 is then cured using a radiation source 40, for example a UV light source. An electron beam or other radiation could be used depending on the type of polymer to be cured. Layer 16 then cures to form the compressible layer of blanket 10.

A second smoothing station 36 then may contact the urethane layer 16 to smooth layer 16 to reduce imperfections such as undulations. Smoothing station 36 may be, for example, a grinding device or surface planer.

Figure 5:
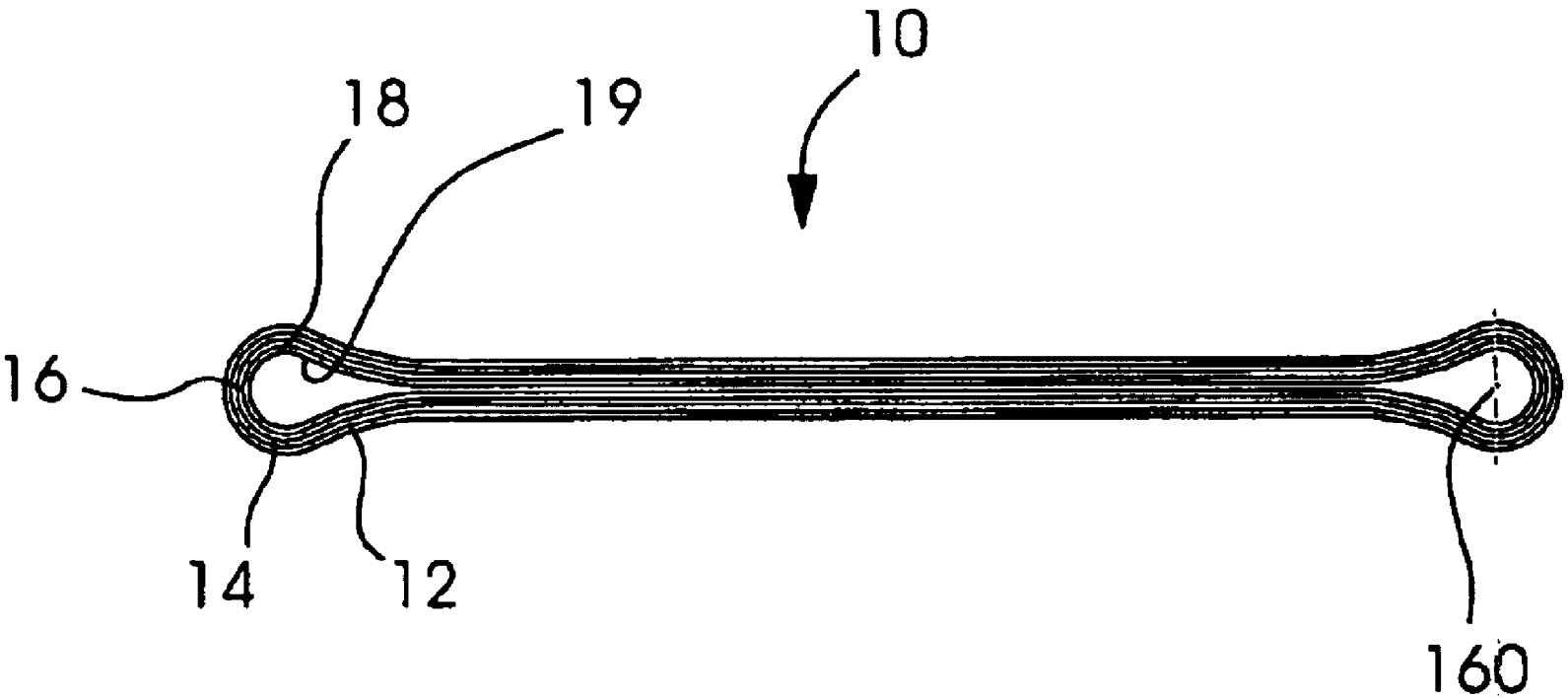
FIG. 5 shows a flexible blanket according to the present invention.

Over the compressible layer 16 after grinding device may deposited, for example by a liquid applicator device, a reinforcing layer 14 (FIG. 5). The durometer of the reinforcing layer, which also may be urethane, preferably is greater than 70 shore A, and preferably about 70 shore D, similar to that of the sleeve 18.

A second liquid applicator 50 similar to device 30 then forms a print layer 12 over the compressible layer 16. The urethane of the print layer may have a shore A durometer value of about 60, for example. The deposited print layer forms a seamless and gapless layer when it sets. If desired, a scraper and/or a grinding device may be used to correct or reduce any imperfections such as undulations in the print layer. Both the print layer 12 and the reinforcing layer may be made from radiation-curing polymers, for example, and a radiation source may be provided after the respective applicators. Ribbon casting can also provide the print layer 12 and reinforcing layer.

Once the print layer 12 is complete, the blanket continues moving in the direction of arrow 5 until a desired length is reached, at which time the blanket is cut, for example by a rotating cutter or saw.

FIG. 5 shows a cross-sectional view of the blanket 10 when compressed by an outside force, the blanket having a sleeve 18, compressible layer 16, reinforcing layer 14 and print layer 12.

As shown an innermost surface 19 of the printing blanket 10 can collapse, so that the surface contacts itself along circumferential sections that normally would not be in contact when the sleeve is round. Cardboard inserts can be provided in spaces 160 so that pinching of the blanket is prevented. Due to the sleeve construction, the blanket returns to its tubular shape when not compressed.

The compressible layer 16 may be made compressible in any manner known in the art, including for example, through the use of microspheres, blowing agents, foaming agents, or leaching. Examples of such methods are disclosed for example in U.S. Pat. Nos. 5,768,990, 5,553,541, 5,440,981, 5,429,048, 5,323,702, and 5,304,267.

As used herein, the term print layer, or printing layer refers to an polymeric material such as urethane which is suitable for transferring an image from a lithographic printing plate or other image carrier to web or sheet of material, with such print quality as the particular printing application requires.

It should be understood that a blanket in accordance with the present invention might also include multiple compressible layers, multiple build up layers, or multiple reinforcing layers.

The reinforcing layer also may be formed by winding fabric or plastic tape, cords or threads around the work piece.

What is claimed is:

1. A method for forming a tubular printing blanket comprising the steps of:

applying an application layer to a base;

applying a polymer over the application layer so as to form a flexible inner tubular sleeve, the application layer being an innermost layer of the tubular sleeve;

applying a print layer over the tubular sleeve, the tubular printing blanket being reversibly deformable; and forming a compressible layer over the flexible tubular sleeve and under the print layer.

2. The method as recited in claim 1 further comprising applying the application layer by winding a tape around the base.

3. The method as recited in claim 1 further comprising rotating the base.

4. The method as recited in claim 1 wherein the printing blanket is capable of being deformed so that two different circumferential points of an inner surface of the sleeve when round contact each other and then the printing blanket may return to a tubular shape.

5. A method for forming a tubular printing blanket comprising the steps of:

applying an application layer to a base;

applying a polymer over the application layer, removing the application layer so that the polymer layer defines an innermost layer of a flexible tubular sleeve; and applying a print layer over the tubular sleeve, the tubular printing blanket being reversibly deformable.

6. The method as recited in claim 5 further comprising forming a compressible layer over the flexible tubular sleeve and under the print layer.

7. The method as recited in claim 5 further comprising applying the application layer by winding a tape around the base.

8. The method as recited in claim 5 further comprising rotating the base.

9. The method as recited in claim 5 wherein the printing blanket is capable of being deformed so that two different circumferential points of an inner surface of the sleeve when round contact each other and then the printing blanket may return to a tubular shape.

10. The method as recited in claim 5 wherein the removing of the application layer occurs prior to the applying of the print layer.

* * * * *